US008245987B2

(12) United States Patent
Hazzard et al.

(10) Patent No.: US 8,245,987 B2
(45) **Date of Patent: *Aug. 21, 2012**

(54) MOUNTING BRACKET FOR USE WITH A WATER HEATER

(75) Inventors: Fritz Hazzard, Plymouth, MN (US); James E. Eickson, Eagan, MN (US); Douglas Bird, Little Canada, MN (US); Bruce L. Hill, Roseville, MN (US)

(73) Assignee: Honeywell International Inc., Morristown, NJ (US)

( * ) Notice: Subject to any disclaimer, the term of this patent is extended or adjusted under 35 U.S.C. 154(b) by 125 days.

This patent is subject to a terminal disclaimer.

(21) Appl. No.: 12/642,449

(22) Filed: Dec. 18, 2009

(65) Prior Publication Data

US 2011/0147549 A1 Jun. 23, 2011

(51) Int. Cl.
*A47B 96/06* (2006.01)

(52) U.S. Cl. ..... 248/213; 122/14.22; 248/217.4; 236/20 R

(58) Field of Classification Search ..... 248/213.2, 248/217.4; 392/498; 122/14.22; 236/20 R
See application file for complete search history.

(56) References Cited

U.S. PATENT DOCUMENTS

| | | | |
|---|---|---|---|
| 3,847,350 | A | 11/1974 | Thompson |
| 3,849,350 | A | 11/1974 | Matsko |
| 4,324,944 | A | 4/1982 | Weihrich et al. |
| RE30,936 | E | 5/1982 | Kmetz et al. |
| 4,333,002 | A | 6/1982 | Kozak |
| 4,467,178 | A | 8/1984 | Swindle |
| 4,508,261 | A | 4/1985 | Blank |
| 4,511,790 | A | 4/1985 | Kozak |
| 4,568,821 | A | 2/1986 | Boe |
| 4,588,875 | A | 5/1986 | Kozak et al. |
| 4,692,598 | A | 9/1987 | Yoshida et al. |
| 4,696,639 | A | 9/1987 | Bohan, Jr. |
| 4,734,658 | A | 3/1988 | Bohan, Jr. |
| 4,742,210 | A | 5/1988 | Tsuchiyama et al. |
| 4,770,629 | A | 9/1988 | Bohan, Jr. |
| 4,834,284 | A | 5/1989 | Vandermeyden |
| 4,984,981 | A | 1/1991 | Pottebaum |
| 4,986,468 | A | 1/1991 | Deisinger |
| 5,007,156 | A | 4/1991 | Hurtgen |
| 5,103,078 | A | 4/1992 | Boykin et al. |
| 5,442,157 | A | 8/1995 | Jackson |
| 5,622,200 | A | 4/1997 | Schulze |
| 5,660,328 | A | 8/1997 | Momber |

(Continued)

FOREIGN PATENT DOCUMENTS

| | | |
|---|---|---|
| EP | 0356609 | 3/1990 |

(Continued)

*Primary Examiner* — Anita M King
*Assistant Examiner* — Monica Millner
(74) *Attorney, Agent, or Firm* — Seager Tufte Wickhem LLC

(57) ABSTRACT

A mounting bracket for mounting a temperature sensor, a gas valve, a power delivery unit, a controller and/or any other suitable object or device to a water heater tank. An illustrative but non-limiting example may be found in a mounting bracket that includes a polymeric body that has a sensor portion configured to receive a temperature sensor. The sensor portion may have a distal end that extends into and supports the temperature sensor within the water heater tank. The polymeric body may also includes a threaded portion that is configured to threadably engage a threaded spud in a water heater tank such that the distal end of the sensor portion extends into the water tank of the water heater.

20 Claims, 9 Drawing Sheets

U.S. PATENT DOCUMENTS 5,779,143 A 7/1998 Michaud et al.
5,797,358 A 8/1998 Brandt et al.
5,896,089 A 4/1999 Bowles
5,968,393 A 10/1999 Demaline
5,975,884 A 11/1999 Dugger
6,053,130 A 4/2000 Shellenberger
6,059,195 A 5/2000 Adams et al.
6,069,998 A 5/2000 Barnes et al.
6,075,923 A 6/2000 Wu
6,208,806 B1 3/2001 Langford
6,212,894 B1 4/2001 Brown et al.
6,261,087 B1 7/2001 Bird et al.
6,271,505 B1 8/2001 Henderson
6,293,471 B1 9/2001 Stettin et al.
6,350,967 B1 2/2002 Scott
6,363,218 B1 3/2002 Lowenstein et al.
6,371,057 B1 * 4/2002 Henderson ..... 122/14.2
6,375,087 B1 4/2002 Day et al.
RE37,745 E 6/2002 Brandt et al.
6,553,946 B1 * 4/2003 Abraham et al. ..... 122/14.22
6,560,409 B2 5/2003 Troost, IV
6,633,726 B2 10/2003 Bradenbaugh
6,701,874 B1 3/2004 Schultz et al.
6,732,677 B2 * 5/2004 Donnelly et al. ..... 122/504
6,795,644 B2 9/2004 Bradenbaugh
6,861,621 B2 3/2005 Ghent
6,880,493 B2 4/2005 Clifford
6,934,862 B2 8/2005 Sharood et al.
6,936,798 B2 8/2005 Moreno
6,955,301 B2 10/2005 Munsterhuis et al.
6,959,876 B2 11/2005 Chian et al.
6,973,819 B2 * 12/2005 Ruhland et al. ..... 73/23.31
7,088,238 B2 8/2006 Karaoguz et al.
7,117,825 B2 10/2006 Phillips
7,137,373 B2 * 11/2006 Seymour et al. ..... 123/90.5
7,162,150 B1 * 1/2007 Welch et al. ..... 392/455
7,221,862 B1 5/2007 Miller et al.
7,252,502 B2 8/2007 Munsterhuis
7,317,265 B2 1/2008 Chian et al.
2004/0042772 A1 3/2004 Whitford et al.
2004/0267385 A1 12/2004 Lingemann
2005/0077368 A1 4/2005 Zak et al.
2005/0147401 A1 7/2005 Baxter
2005/0147402 A1 7/2005 Baxter
2005/0150967 A1 7/2005 Chapman, Jr. et al.
2006/0243816 A1 11/2006 Teti
2007/0023333 A1 2/2007 Mouhebaty et al.
2007/0034169 A1 2/2007 Phillips
2007/0191994 A1 8/2007 Patterson et al.
2007/0246551 A1 10/2007 Phillips et al.
2007/0295823 A1 12/2007 Yamada et al.
2008/0023564 A1 1/2008 Hall
2008/0188995 A1 8/2008 Hotton et al.
2010/0095906 A1 * 4/2010 Leeland et al. ..... 122/14.22
2010/0133258 A1 * 6/2010 Fima ..... 219/482

FOREIGN PATENT DOCUMENTS

EP 0699316 7/1999
GB 2211331 6/1999
JP 8264469 10/1996
JP 2008008548 1/2008

* cited by examiner

MOUNTING BRACKET FOR USE WITH A WATER HEATER

TECHNICAL FIELD

The disclosure relates generally to water heaters, and more particularly, to a mounting bracket for a water heater for mounting a temperature sensor, a gas valve, a power delivery unit, a controller and/or any other suitable object or device to the water heater.

BACKGROUND

Water heaters are used in homes, businesses and just about any establishment having the need for heated water. A conventional water heater typically has at least one heating element or "heater," such as a gas-fired and/or electric burner. Each water heater also typically has at least one thermostat or controller for controlling the heater. The controller typically receives signals related to the temperature of the water within the water heater tank, often from a temperature sensor that is thermally engaged with the water in the water heater tank.

In some instances, a water heater may operate in accordance with a first temperature set point and a second temperature set point. The difference between the first and second temperature set point may be referred to as the temperature differential of the water heater. When temperature signals from the temperature sensor indicate that the water temperature is below the first set point, for example when the water temperature is below about 120° F., the controller may turn on the heater and the water within the water heater tank begins to heat. After some time, the water temperature within the water heater tank will increase to the second set point, which, for example may be about 140° F. At this point, the controller may cause the heater to reduce its heat output or, alternatively, causes the heater to turn off. This heat cycle begins again when the water temperature within the water heater tank cools down below the first set point.

For a gas fired water heater, a temperature sensor, a gas valve and a controller are often mounted relative to the water heater tank. The controller typically receives a temperature signal from the temperature sensor. The temperature sensor often protrudes into and is thermally coupled to the water in the water heater tank. The controller typically is programmed to control the gas valve such that the temperature of the water in the water heater tank remains between the first and second temperature set points, as described above. For an electric water heater, a temperature sensor, a power delivery unit and a controller may be mounted to the water heater tank. In this case, the controller may control the power delivery unit such that the temperature of the water in the water heater tank is kept between the first and second temperature set points.

What would be desirable is an improved mounting bracket for mounting the temperature sensor, the gas valve, the power delivery unit, the controller and/or any other suitable object or device to the water heater tank.

SUMMARY

The present disclosure pertains generally to an improved mounting bracket for mounting a temperature sensor, a gas valve, a power delivery unit, a controller and/or any other suitable object or device to a water heater tank. An illustrative but non-limiting example of the disclosure may be found in a mounting bracket that includes a polymeric body that has a sensor portion configured to receive a temperature sensor. The sensor portion may have a distal end that extends into and supports the temperature sensor within the water heater tank. The polymeric body may also includes a threaded portion that is configured to threadably engage a threaded spud in a water heater tank such that the distal end of the sensor portion extends into the water tank of the water heater.

In some cases, the sensor portion may be an elongated stem that has an internal well for receiving the temperature sensor. The threaded portion may extend around the elongated stem. In some instances, the elongated stem may include a thread lead in region between the threaded portion and the distal end of the elongated stem. The thread lead in region may help guide the mounting bracket relative to the water heater while the sensor portion is inserted into the water heater tank but before the threaded portion of the stem threadably engages the threaded spud of the water heater. In some cases, the distal end of the elongated stem may include a blade element that can be used to help pierce a barrier or the like of the water heater when the mounting bracket is installed on the water heater.

In some embodiments, the mounting bracket may include a component retaining region. The component retaining region may be use to retain a gas valve, a power delivery unit, a controller and/or any other suitable object or device relative to the water heater tank. In some cases, the component retaining region may include two or more ribs for providing additional support to the component retaining region. In some instances, the two or more ribs may radiate out from the elongated stem, but this is not required. In some cases, the polymeric body may be molded as a single piece, and may be made from a material that, when sufficiently stressed, suddenly fractures in a clean break, such as Entec Hylon. In some instances, the polymeric body may be configured to suddenly fracture at or near an outside edge of the threaded spud, but this is not required in all embodiments.

BRIEF DESCRIPTION OF THE FIGURES

The following description should be read with reference to the drawings. The drawings, which are not necessarily to scale, depict selected embodiments and are not intended to limit the scope of the disclosure. The disclosure may be more completely understood in consideration of the following detailed description of various embodiments in connection with the accompanying drawings, in which.

Figure 1:
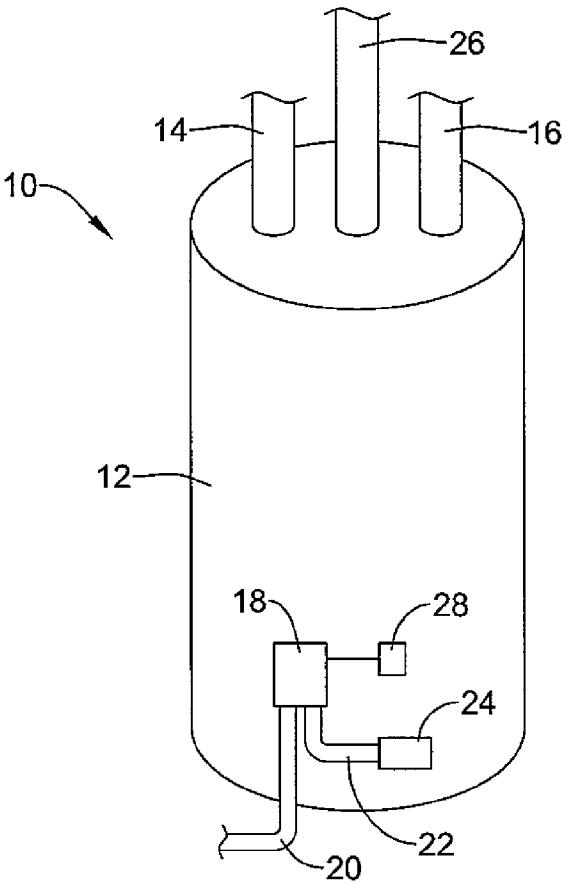
FIG. 1 is a schematic view of an illustrative but non-limiting water heater in accordance with the present disclosure.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 provides a schematic view of an illustrative but non-limiting water heater 10. Water heater 10 includes a water tank 12. The water tank 12 may include an insulating layer (not explicitly shown) positioned about the water tank 12 to help reduce thermal losses from the water tank 12. Cold water enters water tank 12 through a cold water line 14 and is heated by a gas burner 24. In some cases, the water heater 10 may include an electric heating element rather than a gas burner 24. A power delivery unit (not shown) may be used to selectively apply power (i.e. current) to the electric heating element. In either case, the resulting heated water exits through a hot water line 16. For gas-fired water heaters, a gas control unit 18 such as a gas valve regulates gas flow from a gas source 20 through a combustion gas line 22 and into gas burner 24. A flue 26 permits combustion byproducts to safely exit.

Figure 2:
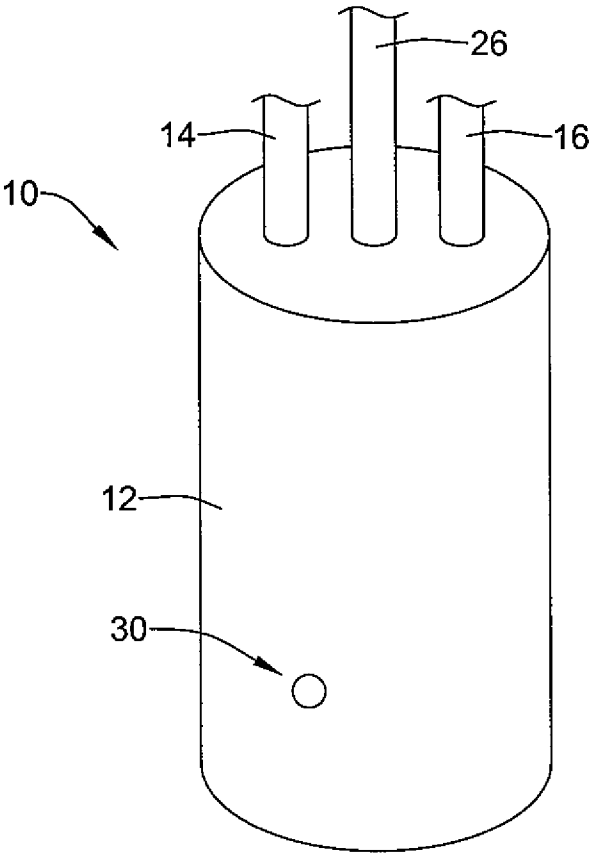
FIG. 2 is a schematic view of an illustrative but non-limiting water heater in accordance with the present disclosure.

As can be seen, water heater 10 includes a temperature sensor 28. In some cases, temperature sensor 28 may enter water tank 12 at a location laterally offset from gas control unit 18. In some instances, however, temperature sensor 28 may instead be located behind gas control unit 18, and in some cases, may be supported and retained by a common mounting bracket such as that described more fully below. In any event, water tank 12 may include an aperture 30 that is sized and configured to accept temperature sensor 28. This can be seen in FIG. 2, in which certain elements of FIG. 1 have been removed for clarity. Aperture 30 may include threads that are configured to accommodate corresponding matching threads on temperature sensor 28. In some cases, temperature sensor 28 has a compression or frictional fit within aperture 30. In other instances, water tank 12 may include a threaded spud (not explicitly shown) that is configured to receive temperature sensor 28.

Figure 3:
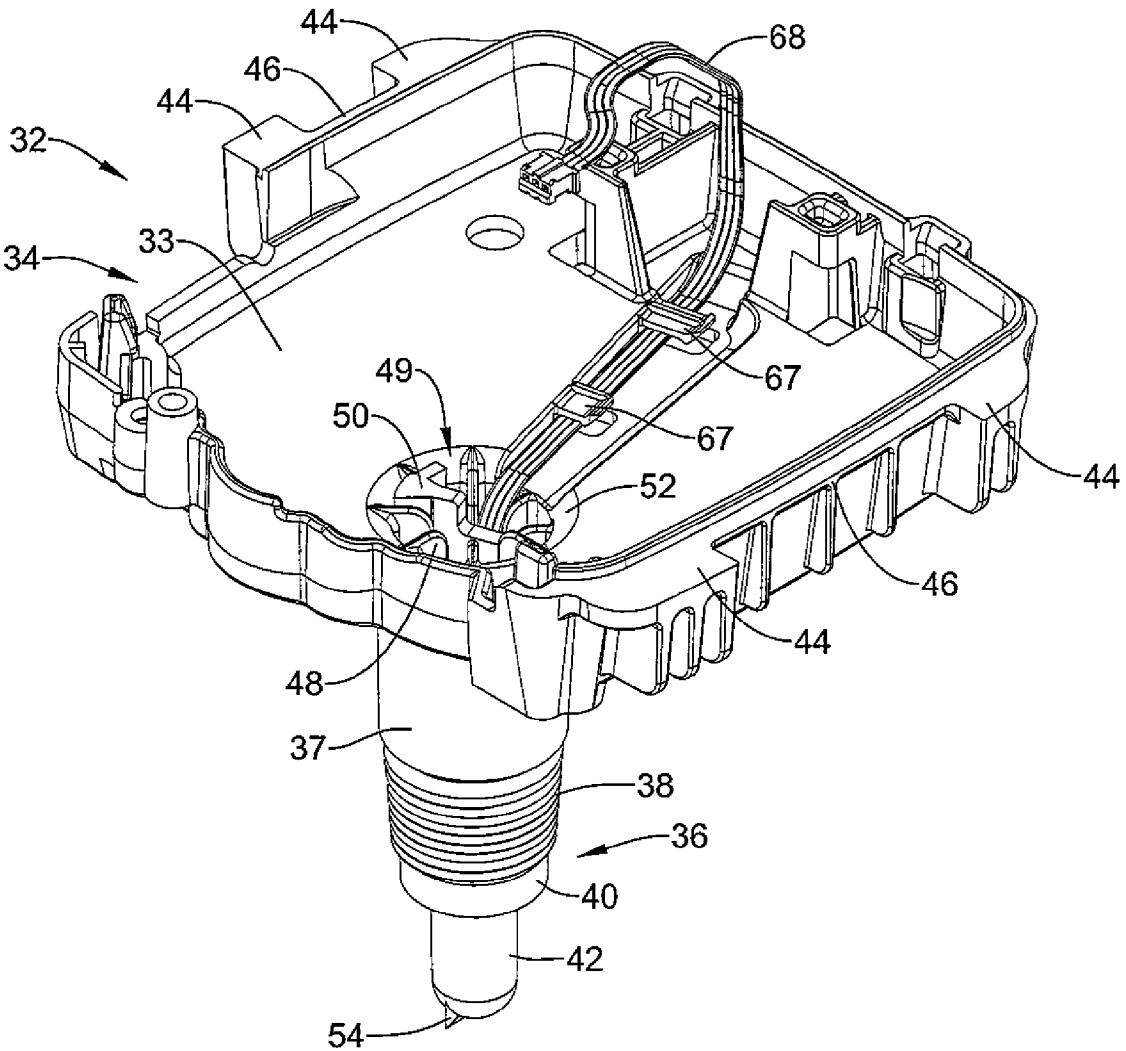
FIG. 3 is a perspective view of an illustrative but non-limiting mounting bracket that may be used in conjunction with the water heater of FIG. 1.

FIG. 3 is a perspective view of an illustrative but non-limiting mounting bracket 32 that may be used in conjunction with the water heater 10. In some instances, the mounting bracket 32 may include a component retaining region 33 and a sensor portion 36 forming an elongated stem. Bracket 32 may be configured to retain a gas valve module and/or a water heater controller module (not explicitly shown) within component retaining region 33, as well as a temperature sensor assembly 49 (see also FIG. 4) within elongated stem 36. In the illustrative embodiment, bracket 32 includes a gas valve retaining portion 34 and a sensor portion 36. Gas valve retaining portion 34 may form at least a portion of a housing of a gas control unit, such as gas control unit 18 of FIG. 1, but this is not required. In some instances, as illustrated, elongated sensor portion 36 may include a threaded portion 38 that can be used to secure bracket 32 to or within aperture 30 (FIG. 2) of water heater spud.

Bracket 32 may be formed of any suitable material. In some cases, bracket 32 may include non-metallic materials such as a polymeric material, glass, ceramic, plastic, and the like. In some cases, bracket 32 may be manufactured as a single piece by injection molding a nylon material such Hylon®, available from Entec Polymers in Manchester, Tenn. The thermal conductivity of such non-metallic materials may be less than those of metallic materials, and as a result, may partially thermally isolate the temperature sensor assembly 49 from the water in the water tank 12, but may be less expensive to produce than a metallic well. It is contemplated that in some cases, bracket 32 may not be formed entirely from the same material, or bracket 32 may not be formed as a single piece. As will be discussed in more detail with respect to FIG. 7, bracket 32 may incorporate safety features to prevent injury from hot water in the event bracket 32 becomes broken or damaged after installation.

Sensor portion 36 of the bracket 32 may include an elongated stem extending from component retaining region 33. Sensor portion 36 may include an internal well 39 (shown in more detail in FIGS. 4 and 4A) for receiving a temperature sensor assembly 49. The elongated stem of sensor portion 36 may include of several different regions. For example, sensor portion 36 may include a first portion 37, a threaded region 38 extending around the exterior of the sensor portion 36, a thread lead-in region 40, and an enclosed distal end region 42. Threaded region 38 may be configured to threadably engage a threaded spud in the water tank 12. Thread lead-in region 40 may be disposed between the distal end region 42 and the threaded region, and may be configured to help guide the sensor portion 36 into the aperture 30 of the water tank 12 with proper alignment for the threaded region 38 to engage the threaded spud in the water tank 12. In some embodiments, the thread lead-in region 40 may have zero draft for maximum effectiveness, but this is not required. When threaded region 38 is engaged with the threaded water heater spud, distal end 42 may be disposed within water tank 12. Distal end 42 may house a temperature sensor such that when the bracket 32 is engaged with the water tank 12, the temperature sensor is in at least partial thermal contact with the water in the water tank 12.

In some instances, distal end region 42 may have a reduced cross-sectional area relative to remaining regions 37, 38 and 40 of sensor portion 36. However, it is contemplated that in some cases, the cross-sectional area of distal end 42 may be the same as, or substantially the same as the remaining regions 37, 38 and 40 of sensor portion 36. In some embodiments, distal end 42 may include a cutting element 54 disposed at or near the tip. In some instances, the cutting element 54 may include a blade-like feature. Cutting element 54 may be capable of puncturing and/or piercing a plastic sheet or barrier commonly wrapped around the water tank 12 of many water heaters during installation of the bracket 32. It is contemplated that in some cases, the cutting element 54 may be omitted from the design.

In some embodiments, bracket 32 may also include two (or more) bosses 44 on a first lateral side, and two (or more) bosses 44 on a second opposing lateral side. While bracket 32 is shown having four bosses 44, it is contemplated that bracket 32 may have any number of bosses 44 as desired, for example, but not limited to, one, two, three, or more. Additionally, it is contemplated that bosses 44 may be disposed on fewer than, or more than, two lateral sides. Bosses 44 may provide, among other things, an area for torque to be applied directly to the bracket 32 during installation. For example, an installation tool may grip and apply torque to bosses 44 to threadably engage threaded region 38 of sensor portion 36 with the threaded water heater spud on a water tank 12. In some instances, bosses 44 may further include a rib 46 disposed between adjacent bosses 44. Rib(s) 46 may provide additional support to the bracket 32, and may also help prevent an installation tool from contacting the component retaining region 33 of bracket 32 during installation.

Figure 4:
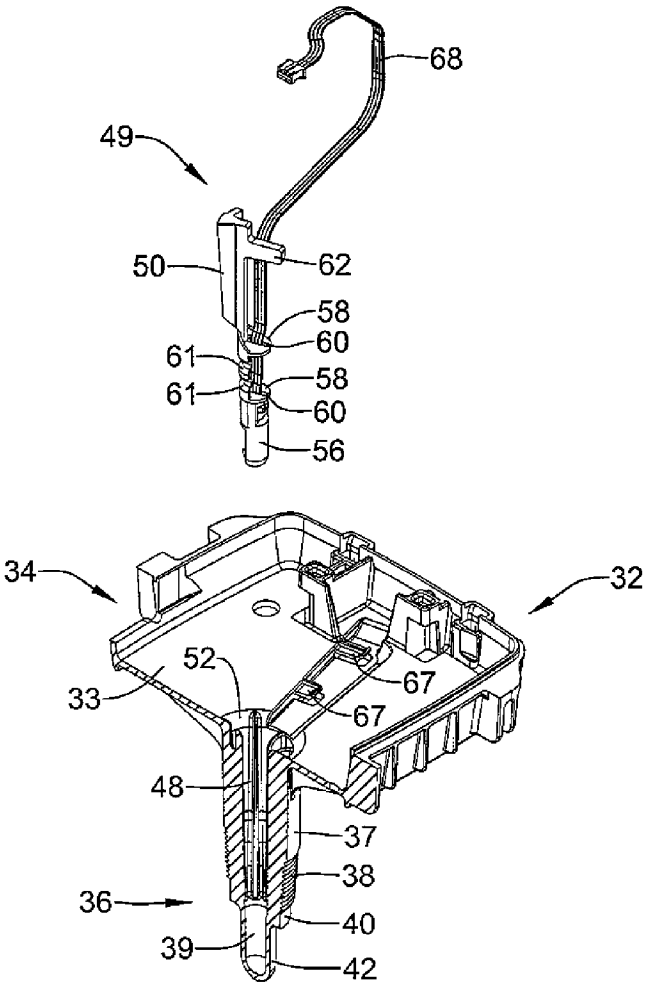
FIG. 4 is a perspective view, partially in cross-section, of an illustrative but non-limiting mounting bracket and temperature sensor assembly.

Turning now to FIG. 4, which is a perspective view, partially in cross-section, of an illustrative but non-limiting mounting bracket 32 and temperature sensor assembly 49. The temperature sensor assembly 49 is shown pulled out of the sensor region 36 and situated above the bracket 32 in an exploded view form. As can be seen, the sensor portion 36 may be configured to accommodate the temperature sensor assembly 49. In the illustrative embodiment, temperature sensor assembly 49 includes one or more heat traps 58 that are attached to or otherwise secured to sensor assembly structure 50, and may serve to help limit or at least partially limit heat flow out of the sensor portion 36 of the bracket 32. Sensor assembly structure 50 may further include one or more convolutions 61. When the sensor assembly structure 50 is assembled within sensor portion 36, convolutions 61 may apply a spring-like force that holds the temperatures sensor 56 in tight contact with the bottom of the internal well 39. Convolutions 61 may also reduce the need to use a fastener to secure the temperature sensor assembly 49. Temperature sensor assembly 49 may be configured to accommodate a temperature sensor 56. In some cases, temperature sensor 56 may be a single temperature sensor. In other instances, temperature sensor 56 may include multiple temperature sensors, which may provide a measure of redundancy and/or increased accuracy in a corresponding temperature measurement. In some cases, the temperature sensor 56 may include a thermopile or thermocouple.

During assembly, it will be appreciated that heat traps 58 and temperature sensor 56 may be attached to a sensor assembly structure 50. This may be accomplished by snap fits, frictional fits, glue, screws, rivets, or any other suitable attachment mechanism. In some instances, heat traps 58 may be integrally molded or otherwise formed as part of sensor assembly structure 50. In some cases, the heat traps 58 may each include a slot 60 in order to accommodate and/or secure a wiring harness 68 for the temperature sensor 56. Once heat traps 58 and temperature sensor 56 have been secured or otherwise attached to sensor assembly structure 50, sensor assembly structure 50 may be inserted into a void 52 that is molded or otherwise formed within sensor portion 36. It can be seen that sensor assembly structure 50 may include one or more protrusions such as protrusion 62 that may help to locate sensor assembly structure 50 within void 52 and/or limit penetration of sensor assembly structure 50 into void 52 while allowing wiring harness 68 to pass without being pinched. The one or more protrusions 62 may align the sensor assembly structure 50 with inwardly extending ribs 48 disposed on the inner walls of the sensor portion 36 and into the void. One or more protrusions 62 in cooperation with one or more ribs 48 may, in some instances, help properly align and assemble the temperature sensor assembly 49 within the sensor portion 36. One or more protrusions 62 may also ensure that sensor assembly 49 is not installed in the wrong bracket. As can be seen, when temperature sensor assembly 49 is assembled within sensor portion 36, sensor 56 may be disposed within an internal well 39 within the distal tip portion 42 of the sensor portion.

Figure 4A:
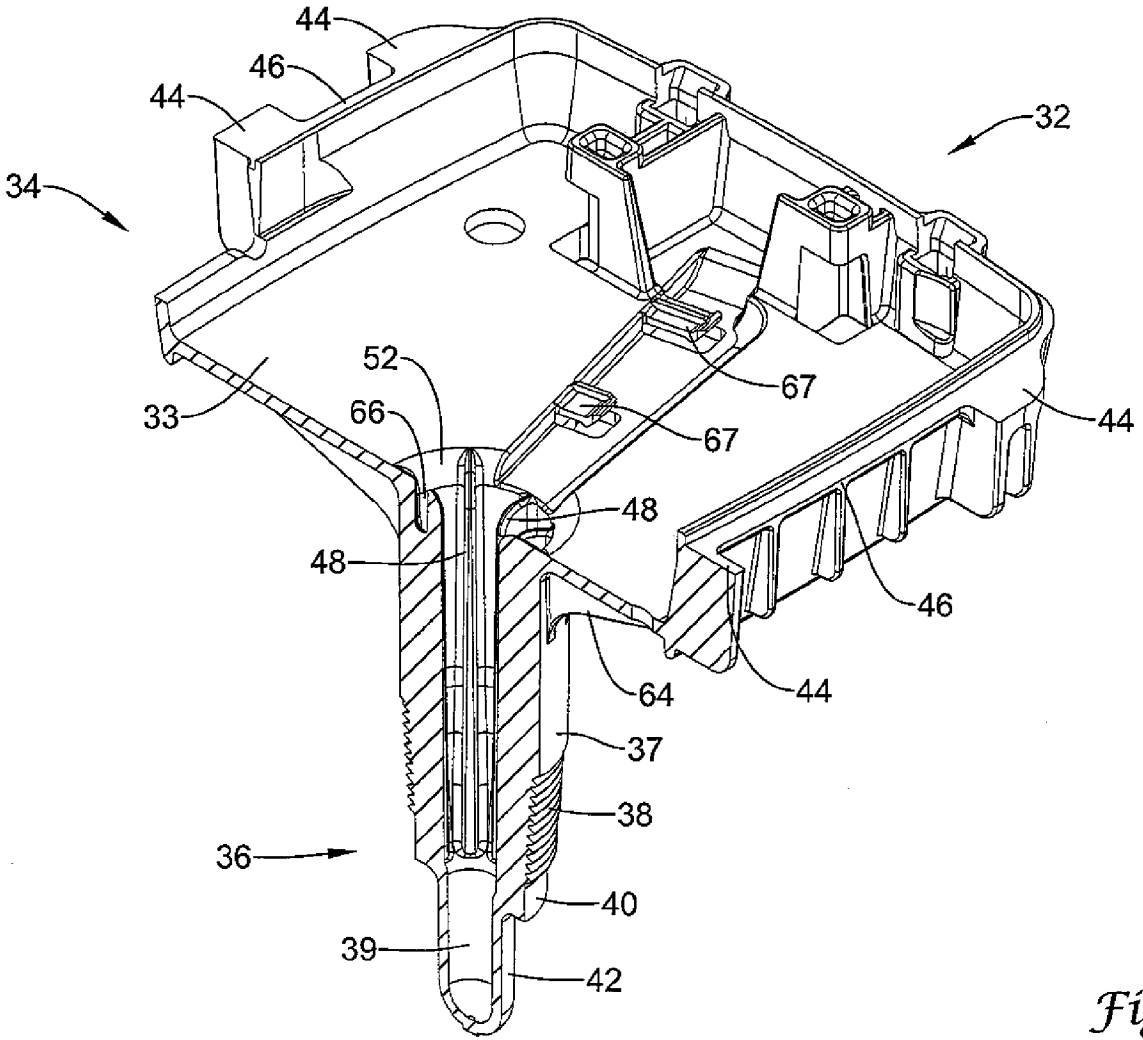
FIG. 4A is a perspective view, partially in cross-section, of the illustrative but non-limiting mounting bracket of FIG. 4, with the temperature sensor assembly not shown.

FIG. 4A is a perspective view, partially in cross-section, of the illustrative but non-limiting mounting bracket of FIG. 4, with the temperature sensor assembly not shown. As discussed above, the void 52 within the sensor region 36 may include inwardly extending ribs 48. Ribs 48 may extend any length along the void 52, as desired. While ribs 48 are shown extending to a distal end of threaded region 38, it is contemplated in some embodiments, ribs 48 may extend past threaded region 38. In other embodiments, ribs 48 may terminate short of threaded region 38, or at any point within threaded region 38. It is further contemplated that there may be any number of ribs 48 as desired, for example, but not limited to, one, two, three, four, or more. In some embodiments, sensor portion 36 may include one or more slots 66 for receiving one or more protrusions such as protrusion 62 that may help locate temperature assembly structure 50 within void 52 and/or limit penetration of temperature assembly structure 50 into void 52.

Figure 5:
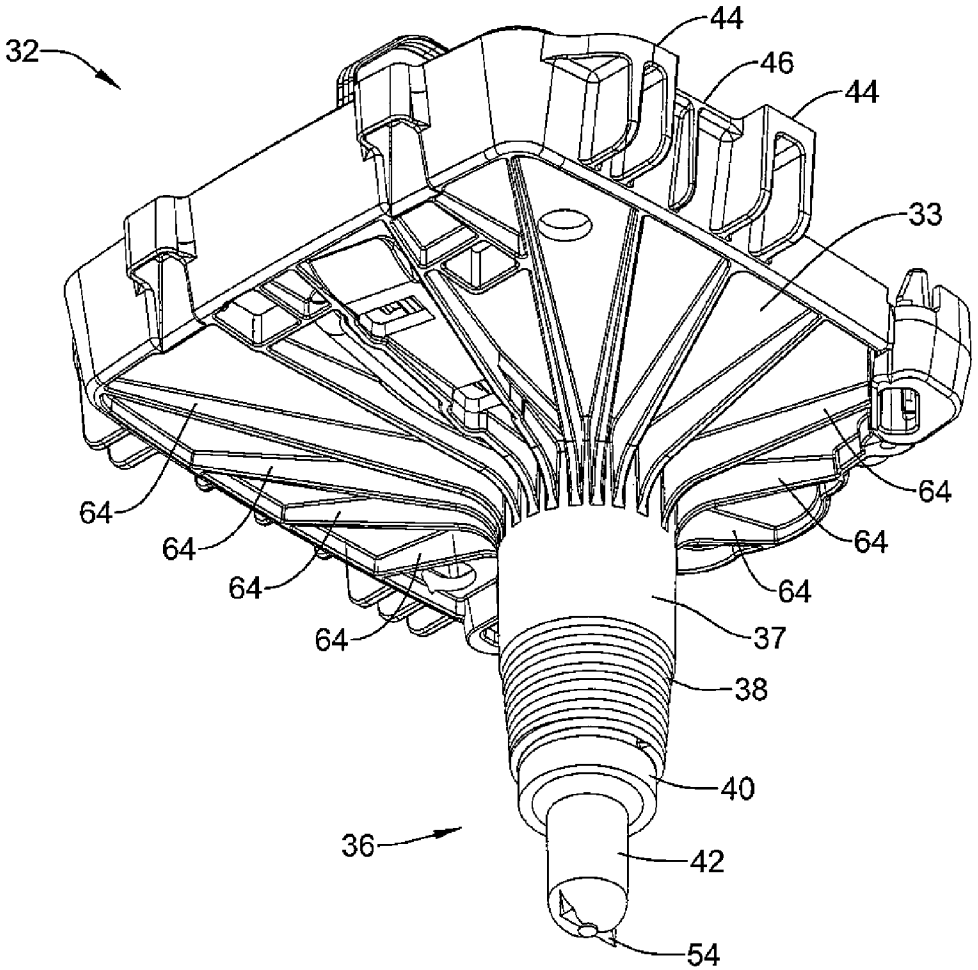
FIG. 5 is another perspective view of the illustrative but non-limiting mounting bracket of FIG. 3.

FIG. 5 is another perspective view of the illustrative but non-limiting mounting bracket of FIG. 3. In the illustrative but non-limiting example, the bracket 32 includes a number of outer ribs 64 extending along the back of component retaining region 33 of bracket 32 and to the first region 37 of sensor portion 36. For clarity, not all ribs 64 have been identified with a reference numeral. In some cases, outer ribs 64 may not extend all the way to sensor portion 36, while in other cases, ribs 64 may extend further along sensor portion 36 towards threaded region 38. The number of ribs 64 may vary as desired depending on the application. For example, bracket 32 may have zero ribs 64, as few as one rib 64, more than 14 ribs, or any other number of ribs 64 as desired. As shown, the ribs 64 may radiate out from the elongated stem of the sensor region 36, but this is not required.

It is contemplated that the ribs 64 may provide additional strength to bracket 32. In some cases, the ribs 64 may be sufficient for the bracket 32 to withstand a 500 pound-force (1 bf) static vertical load (roughly equivalent to a 300 lb person stepping on the installed bracket). When so provided, bracket 32 may resist accidental breakage. In the event bracket 32 breaks or fails, however, bracket 32 may have other safety features to help prevent a user from being exposed to hot water from the water tank 12, as will be discussed in more detail below with respect to FIG. 7.

Figure 6:
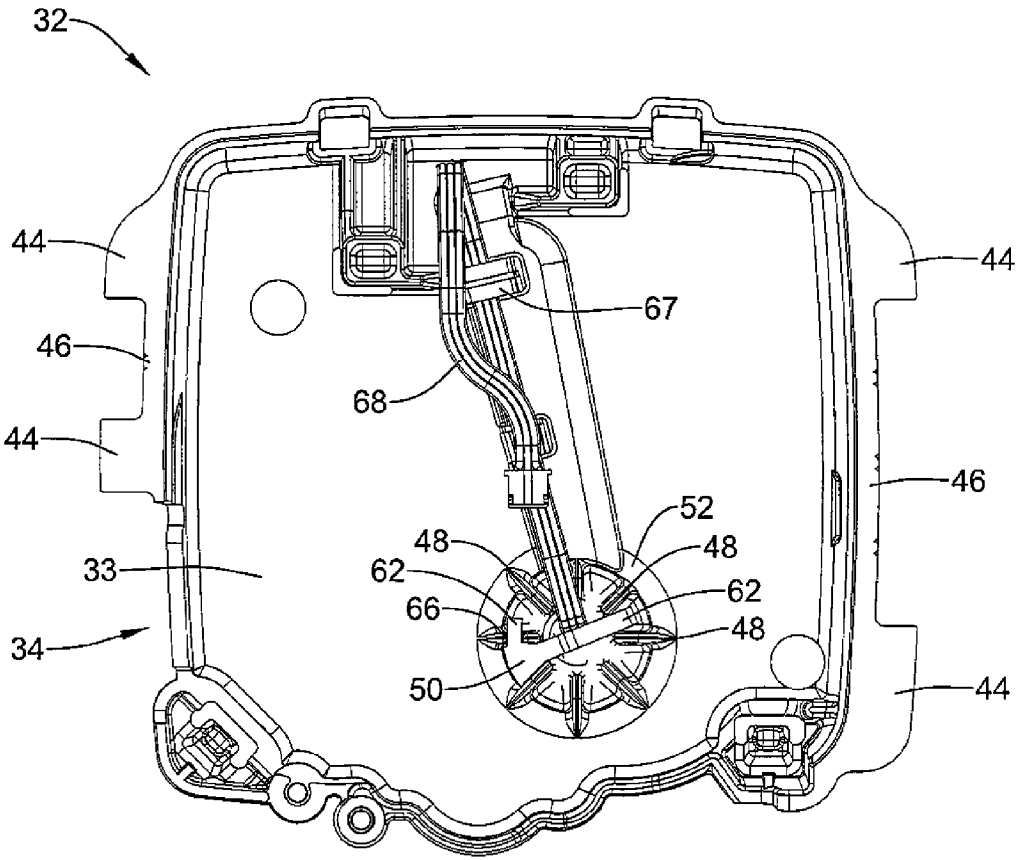
FIG. 6 is a top plan view of the illustrative but non-limiting mounting bracket of FIG. 3.

FIG. 6 is a top plan view of the illustrative but non-limiting mounting bracket 32 of FIG. 3, with the temperature sensor assembly 49 positioned within void 52 such that temperature sensor 56 is disposed within the internal well 39. As discussed above, and in some embodiments, one or more protrusions 62 may be positioned between internal ribs 48 or within slot 66. Internal ribs 48 may be radially spaced within void 52. While ribs 48 are illustrated as equally spaced around the circumference of void 52, it is contemplated that internal ribs 48 may be spaced at any distance desired, or may not be present at all. Additionally, while void 52 is illustrated as having a circular cross-section, it is contemplated that void 52 may have any cross-section shape as desired, such as, but not limited to, square, rectangular, elliptical, or polygonal. Wiring harness 68 may be configured to extend from temperature sensor assembly 49 and to a gas control unit, such as the gas control unit 18 illustrated in FIG. 1. Component retaining region 33 may include retaining elements 67 for retaining wiring harness 68. Retaining elements 67 may be molded in such a way as to allow the use of an optical sensor in production to ensure that the wiring harness 68 and/or sensor wires are properly installed. For example, bracket 32 may be molded such that an opening is present behind retaining elements 67. While not explicitly shown, component retaining region 33 may also include retaining elements for retaining a water heater controller module and/or gas valve module, if desired.

Figure 7:
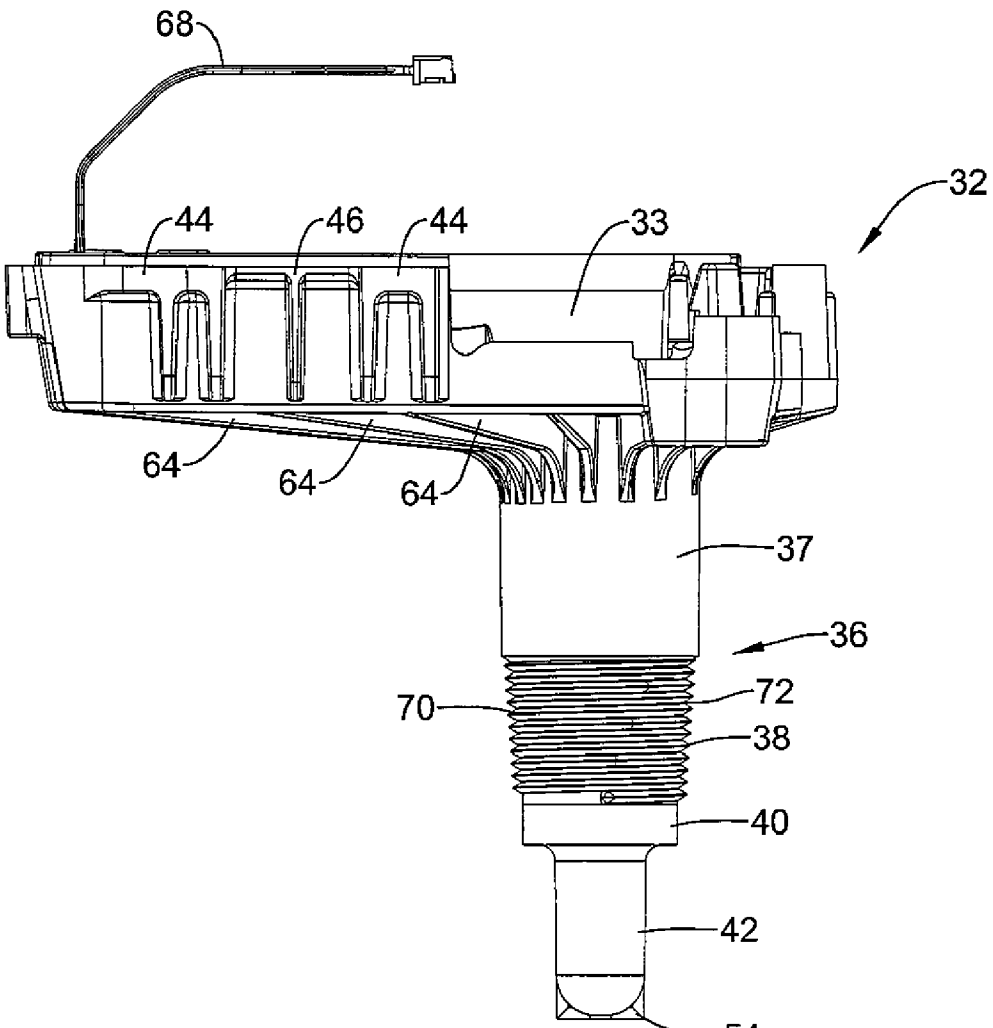
FIG. 7 is a side view of the illustrative but non-limiting mounting bracket of FIG. 3.

FIG. 7 is a side view of the illustrative but non-limiting mounting bracket of FIG. 3, with the temperature sensor assembly 49 disposed within void 52 (not explicitly shown). Threaded region 38 may be configured to provide additional safety features to bracket 32, if desired. For example, threaded region 38 may include a plurality of threads 70 spaced a distance apart. Geometric dimensioning and tolerancing may be used to control the angle and roundness of the threads 70. In some embodiments, threads 70 may be spaced such that there are 13.9-14.0 threads per inch. In other embodiments, it is contemplated that there may be more or fewer threads per inch. In one example, threads 70 may be spaced to ensure that the material in the threads 70 is in compression, and not in tension. This may increase the strength of the threaded region 38 when torque is being applied during installation of the bracket 32, as well as increasing the strength to support a vertical load. In some cases, threaded region 38 may be able to withstand 75 foot-pounds (ft-lbs), or more, of torque. In some embodiments, the root 72 of threads 70 may be rounded to relieve stress in the threads 70. A round root 72 may increase the strength during application of torque as well as for a vertical load.

In the event that a torque or a vertical load is applied to the bracket 32 that exceeds the design load limits, or the bracket 32 is otherwise sufficiently stressed, bracket 32 may break in a sudden manner resulting in a brittle fracture. A suitable material for creating such a break is Entec Hylon, however, other materials may be used. The stress from such an event may be concentrated in the last thread 70 that engages the water heater spud. A brittle material may result in a clean break at or near the outside edge of the water heater spud such that the portion of the sensor portion 36 that has been threadably engaged with the water heater spud remain positioned within the water heater spud. For example, if a breakage occurs, the distal portion 42 and part of the threaded region 38 of the sensor portion 36 may remain disposed within the water tank 12 and water heater spud. This may help prevent significant leakage of hot water from the water heater. Once the water is removed, or the water is cooled, the internal ribs 48 (see FIG. 6) disposed within the void 52 may be used to axially align a removal tool, for example, a TORX bit, and to provide a surface to which torque may be applied to remove the broken off portion of the bracket 32 from the water heater. If ribs 48 are not present in the remaining portion of the sensor portion 36, a removal tool having sharp blades may dig into the interior surface of the internal well 39 to remove the broken off portion.

Figure 8:
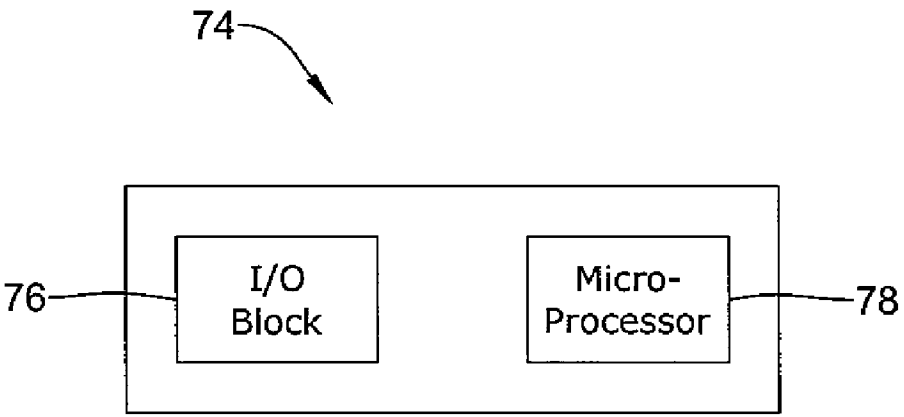
FIG. 8 is a block diagram of a controller that may be used with the water heater of FIG. 1.

Returning briefly to FIG. 1, it will be appreciated that gas control unit 18 may include a controller. FIG. 8 is a block diagram of such a controller 74. The controller 74 may be considered as being a portion of gas control unit 18, or separate from gas control unit 18. Controller 74 may have several modules. In some cases, controller 74 may have an INPUT/OUTPUT block 76 that accepts signals from temperature sensor 28 (FIG. 1) and/or temperature sensor assembly 49 (FIG. 3). If water heater 10 is in communication with an external thermostat or other HVAC controller, INPUT/OUTPUT block 76 may accommodate externally-derived control signals, and/or provide status and/or other information, as desired. In some cases, INPUT/OUTPUT block 76 may also provide appropriate output command signals to an electrically controlled gas valve (not illustrated) within gas control unit 18.

In some instances, controller 74 may include a microprocessor 78 that may be configured to accept appropriate signals from INPUT/OUTPUT block 76, and to determine appropriate output signals that can be outputted via INPUT/OUTPUT block 76, such as to other components within gas control unit 18 (FIG. 1) and/or to an external thermostat or other HVAC controller. Microprocessor 78 may be programmed to accept a temperature signal from temperature sensing assembly 32 (FIG. 3), and to calculate or otherwise determine a command temperature that alters the temperature value received from the temperature sensing assembly 32 in order to account or compensate for temperature differentials and/or thermal lag caused by the partial thermal isolation (if present) of the temperature sensor 56 from the water in the water tank 12. While not explicitly illustrated, microprocessor 78 may also include memory and/or other components. A further discussion of the operation of one illustrative controller 74 and algorithms can be found in co-pending U.S. patent application Ser. No. 12/255,592, filed Oct. 21, 2008, and entitled "WATER HEATER WITH PARTIALLY THERMALLY ISOLATED TEMPERATURE SENSOR", the entirety of which is incorporated herein by reference.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A bracket for a water heater with a water tank, the bracket comprising:

a polymeric body having a sensor portion, the sensor portion configured to receive a temperature sensor at least partially within the sensor portion; and wherein the polymeric body includes a threaded portion that is configured to threadably engage a threaded spud of the water heater such that the sensor portion extends into the water tank of the water heater, and such that a fluid-tight seal is provided between the bracket and the water tank; and wherein, when sufficiently stressed, the polymeric body is configured to break such that the bracket maintains a fluid-tight seal with the water tank.

2. The bracket of claim 1, wherein the sensor portion includes an elongated stem that has an internal well for receiving the temperature sensor.

3. The bracket of claim 2, wherein the internal well is defined by a wall having one or more ribs, wherein the ribs are configured to properly position the temperature sensor within the well.

4. The bracket of claim 2, wherein the threaded portion extends around the elongated stem.

5. The bracket of claim 4, wherein the elongated stem has a distal end that terminates inside of the water tank when the bracket is installed on the water heater, and wherein the elongated stem includes a thread lead in region between the threaded portion and the distal end of the elongated stem, the thread lead in region guiding the bracket relative to the water heater before the threaded portion of the stem threadably engages the threaded spud of the water heater.

6. The bracket of claim 2, wherein the elongated stem has a distal end that terminates inside of the water tank when the bracket is installed on the water heater, and wherein the distal end includes a blade element to help pierce a barrier when the bracket is installed on the water heater.

7. A bracket for a water heater with a water tank, the bracket comprising:

a polymeric body having a sensor portion, the sensor portion configured to receive a temperature sensor at least partially within the sensor portion; and wherein the polymeric body includes a threaded portion that is configured to threadably engage a threaded spud of the water heater such that the sensor portion extends into the water tank of the water heater;

wherein the polymeric body includes a material that, when sufficiently stressed, suddenly fractures in a clean break.

8. The bracket of claim 7, wherein, when sufficiently stressed, the polymeric body is configured to suddenly fracture at or near an outside edge of the threaded spud of the water heater.

9. The bracket of claim 7, wherein the polymeric body includes Entec Hylon.

10. A bracket for a water heater with a water tank, the bracket comprising:

a polymeric body having a sensor portion, the sensor portion includes an elongated stem that has an internal well for receiving a temperature sensor;

wherein the polymeric body includes a threaded portion that is configured to threadably engage a threaded spud of the water heater such that the sensor portion extends into the water tank of the water heater; and a component retaining region, wherein the component retaining region includes two or more ribs for providing additional support to the component retaining region.

11. The bracket of claim 10, wherein the two or more ribs radiate out from the elongated stem.

12. The bracket of claim 11, wherein the component retaining region includes retaining elements for retaining a gas valve module.

13. The bracket of claim 12, wherein the component retaining region includes retaining elements for retaining a water heater controller module.

14. The bracket of claim 10, wherein the component retaining region includes a first boss along one lateral side and a second boss along the same lateral side, with a rib extending between the first boss and the second boss.

15. A bracket for a water heater with a water tank, the bracket comprising:

a polymeric body having a sensor portion, the sensor portion configured to receive a temperature sensor at least partially within the sensor portion; and wherein the polymeric body includes a threaded portion that is configured to threadably engage a threaded spud of the water heater such that the sensor portion extends into the water tank of the water heater;

wherein the polymeric body is molded as a single piece.

16. A bracket for a water heater with a water tank, the bracket comprising:

a body having a component retaining region and an elongated stem extending from the component retaining region, the elongated stem having an internal well for receiving a temperature sensor;

the body including a threaded portion that extends around the elongated stem for threadably engaging a threaded spud of the water heater such that the elongated stem extends into the water tank of the water heater; and the body being molded as a single piece from a polymeric material.

17. The bracket of claim 16, wherein the component retaining region includes retaining elements for retaining a gas valve module.

18. The bracket of claim 16, wherein the component retaining region includes retaining elements for retaining a water heater controller module.

19. A bracket for a water heater with a water tank, the bracket comprising:

a body having a component retaining region, and an elongated stem extending from the component retaining region, the elongated stem having an internal well for receiving a temperature sensor;

the body including a threaded portion that extends around the elongated stem for threadably engaging a threaded spud of the water heater such that the elongated stem extends into the water tank of the water heater;

the internal well of the elongated stem including one or more inwardly extending ribs;

the component retaining region including two or more ribs for providing added strength;

the component retaining region includes retaining elements for retaining a gas valve module and a water heater controller module; and at least a majority of the body being made from a polymeric material.

20. The bracket of claim 19 wherein the polymeric material is a plastic.

* * * * *